US009475550B2

(12) United States Patent
FormyDuval

(10) Patent No.: US 9,475,550 B2
(45) Date of Patent: Oct. 25, 2016

(54) PROPELLER PROTECTION SHIELD FOR A BOAT AND METHOD OF USE THEREOF

(71) Applicant: Cory FormyDuval, Rolesville, GA (US)

(72) Inventor: Cory FormyDuval, Rolesville, GA (US)

( * ) Notice: Subject to any disclaimer, the term of this patent is extended or adjusted under 35 U.S.C. 154(b) by 232 days.

(21) Appl. No.: 14/285,982

(22) Filed: May 23, 2014

(65) Prior Publication Data

US 2015/0336635 A1 Nov. 26, 2015

(51) Int. Cl.
*B63B 17/00* (2006.01)
*B63B 59/00* (2006.01)

(52) U.S. Cl.
CPC ..... *B63B 17/00* (2013.01); *B63B 59/00* (2013.01); *Y10T 29/49828* (2015.01)

(58) Field of Classification Search
CPC ..... B63B 17/00; B63B 2017/0045; B63B 2221/16; B63B 59/04; B63B 59/045; B63B 59/00
USPC ..... 114/145 R, 145 A, 222, 361; 440/71, 72; 416/247 R, 247 A
See application file for complete search history.

(56) References Cited

U.S. PATENT DOCUMENTS

| | | | | | |
|---|---|---|---|---|---|
| 3,142,283 | A * | 7/1964 | Fisher | B63B 59/045 | 114/222 |
| 3,570,256 | A * | 3/1971 | Thompson | B63B 59/045 | 114/222 |
| 3,587,508 | A * | 6/1971 | Pearce | B63H 20/36 | 150/166 |
| 5,152,242 | A * | 10/1992 | Bradley | B63B 59/045 | 114/222 |
| 5,315,949 | A * | 5/1994 | Bradley | B63B 59/045 | 114/222 |
| 5,577,455 | A * | 11/1996 | Dvorak | E02B 3/20 | 114/219 |
| 5,660,136 | A | 8/1997 | Pignatelli et al. | | |
| 5,964,174 | A | 10/1999 | Coggan | | |
| 6,152,064 | A | 11/2000 | Morton | | |
| 6,302,050 | B1 | 10/2001 | Ziehm | | |
| D515,009 | S * | 2/2006 | Stepp | D12/317 | |
| 7,237,503 | B2 | 7/2007 | Stepp | | |
| 7,455,023 | B2 * | 11/2008 | Gerstenberger | B63B 59/045 | 114/221 R |
| 8,590,470 | B2 | 11/2013 | Ploch | | |
| 2007/0128045 | A1 | 6/2007 | McNerney | | |

* cited by examiner

*Primary Examiner* — Ajay Vasudeva
(74) *Attorney, Agent, or Firm* — Jeffrey C. Watson; Grell & Watson Patent Attorneys

(57) ABSTRACT

A propeller protection shield for a propeller of a boat includes a weighted skirt and an attachment. The weighted skirt has a height and a width. The height of the weighted skirt extends from the surface of the water to below the boat propeller. The width of the weighted skirt extends at least the propeller width. The attachment secures the weighted skirt to the back of the boat behind the propeller. The weighted skirt is positioned approximately vertical in the water behind the propeller. The weighted skirt shields the propeller from contact in the water.

15 Claims, 8 Drawing Sheets

PROPELLER PROTECTION SHIELD FOR A BOAT AND METHOD OF USE THEREOF

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field

The disclosure generally relates to boat safety accessories for boaters. More specifically, the disclosure relates to a propeller protection shield for boaters and a method of use thereof.

2. Description of Related Art

Personal boating is a popular activity in many bodies of water, like lakes, rivers, oceans, etc. Different types of drive assemblies are available for propelling personal watercraft. For example, an outboard motor is a propulsion system for boats, consisting of a self-contained unit that includes engine, gearbox and propeller or jet drive, designed to be affixed to the outside of the transom. They are the most common motorized method of propelling small watercraft. A sterndrive or inboard/outboard drive (I/O) is a form of marine propulsion which combines inboard power with outboard drive. The engine sits just forward of the transom while the drive unit (outdrive) lies outside the hull. The IO drive assembly may be desired as it places the propeller unit in a position spaced apart from the boat transom and in a substantially unobstructed position. This can be compared to prior propulsion systems having a shaft located through a boat hull with the propeller unit located under the boat and away from the transom.

No matter what type of drive, most personal watercraft incorporate a propeller for propelling the boat. Boat propellers, like fans, push water to propel the boat. As the propeller blades rotate, each blade edge cuts through the water, forcing the water over the curved surface of each blade. This action channels or redirects the water, imparting the directional drive needed to propel the boat forward or backward. As such, it is readily understood that for the most optimum performance and efficiency of boat propellers, the blades should have sharp razor-like edges.

Any contact with any edge of these sharp propeller blades can cause injuries extending from relatively minor lacerations or cuts to relatively more serious trauma or slashes.

When the watercraft is parked on a beach or anchored for swimming, regardless of the drive type, i.e. whether outboard, I/O, etc., the propeller of the drive unit typically remains submerged in the water. Experienced boaters or swimmers may be aware of the sharpness of the propeller blade and location of the propeller, and thus may know the areas not to swim behind the boat. However, non-experienced boaters and swimmers, especially children, may not understand the sharpness of the propeller blade and/or the location of the propeller. Thus, it should be readily understood that in a recreational setting, this combination of a submerged propeller with dangerously sharp edges presents a serious safety hazard to boaters, especially with children, who often venture too near a submerged propeller of an anchored or beached personal watercraft.

As a specific example, for persons entering or exiting a boat during recreational swimming, entrance and exit of the boat may typically be made by a ladder or step located directly off of the back of the boat and just above or beside the propeller. This obviously presents a potentially dangerous situation because the location of the submerged propeller and the primary pathway to enter and exit the boat are so close together.

Currently there are a few devices designed to encase the engine with the propeller and/or just the propeller. However, these products are very difficult and time consuming to install and/or be removed. In addition, the currently available products are bulky, heavy and/or difficult to store inside or on the desired personal watercraft.

Therefore, it is readily apparent that there is a recognizable unmet need for a device that provides protection from the propeller for boaters while being easy to install, easy to remove, is lightweight, and can be easily stored on or in a boat.

SUMMARY

Briefly described, in a preferred embodiment, the present apparatus and method overcomes the above-mentioned disadvantages and meets the recognized need for such a device by providing a propeller protection shield for a propeller of a boat that provides protection from the propeller for boaters while being easy to install, easy to remove, is lightweight, and can be easily stored on or in a boat.

The present apparatus and method includes a propeller protection shield for a propeller of a boat, wherein the propeller protection shield may include a weighted skirt and an attachment means. The weighted skirt may have a height and a width. The height of the weighted skirt may extend from the surface of the water to below the boat propeller. The width of the weighted skirt may extend at least the propeller width. The attachment means may be for securing the weighted skirt to the back of the boat behind the propeller. Wherein, the weighted skirt may be positioned and/or may rest at approximately vertical in the water behind the propeller. Whereby, the weighted skirt may shield the propeller from contact in the water.

One feature may be the optional sinker or sinkers included in the bottom portion of the weighted skirt that may sink the bottom of the weighted skirt.

Another feature may be the optional float or floats included in the top portion of the weighted skirt that may maintain the top of the weighted skirt at the surface of the water.

Another feature may be the inclusion of at least one layer of marine grade material.

Another feature may the inclusion of a layer or layers of reinforcing material.

Another feature may be the ability for the layers to be sewn together to create a plurality of horizontal pockets within the weighted skirt, whereby a plurality of the reinforcing materials may be positioned in the plurality of horizontal pockets.

Another feature may be that the attachment means may secure the weighted skirt below the swim platform.

Another feature may be that the attachment means may include an eyelet in each top corner of the weighted skirt, and a securing line for each eyelet that connects the weighted skirt to the back of the boat via each eyelet.

Another feature may be the ability to be foldable.

Another feature may be the shape of the weighted skirt can be rectangular or square with a squared off bottom portion.

Another feature may be the shape of the weighted skirt can be rectangular or square with a rounded off bottom portion, with rounded bottom corners.

In use, a method of shielding the propeller of a boat for protecting boaters may utilize various embodiments of the propeller protection shield as shown and described herein. The method of shielding the propeller of a boat for protecting boaters may include the steps of: providing the propeller protection shield in any of the various embodiments shown and described herein; positioning the propeller protection shield behind the propeller; and attaching the propeller protection shield to the back of the boat behind the propeller, whereby, the propeller protection shield shields the propeller from contact in the water.

These and other features of the propeller protection shield for boaters and its method of use thereof will become more apparent to one skilled in the art from the prior Summary, and following Brief Description of the Drawings, Detailed Description, and Claims when read in light of the accompanying Detailed Drawings.

BRIEF DESCRIPTION OF THE DRAWINGS

The present propeller protection shield for boaters will be better understood by reading the Detailed Description with reference to the accompanying drawings, which are not necessarily drawn to scale, and in which like reference numerals denote similar structure and refer to like elements throughout, and in which.

Figure 1:
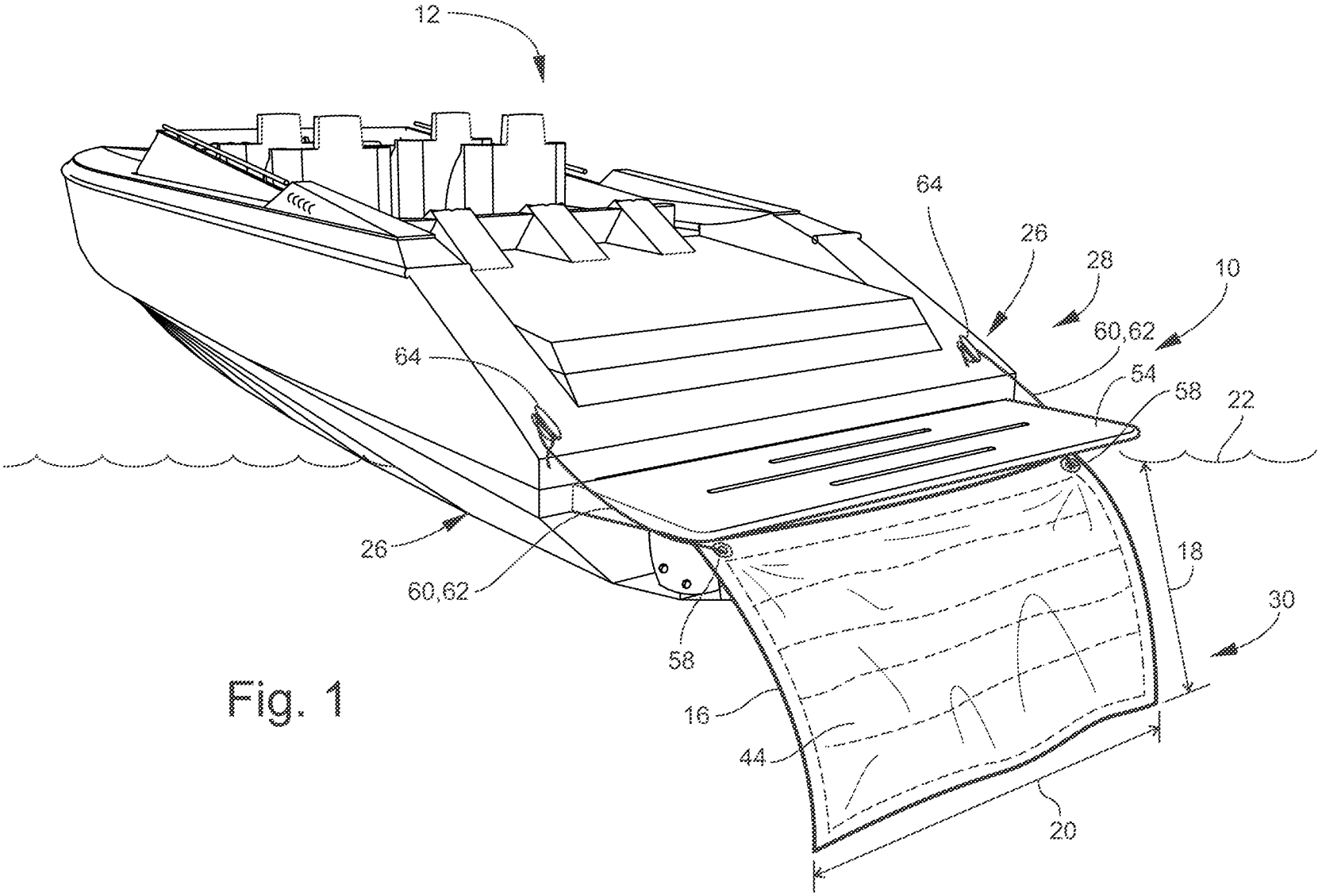
FIG. 1 is a perspective view of an exemplary embodiment of the propeller protection shield mounted on the back of a boat with a square bottom.
Figure 2:
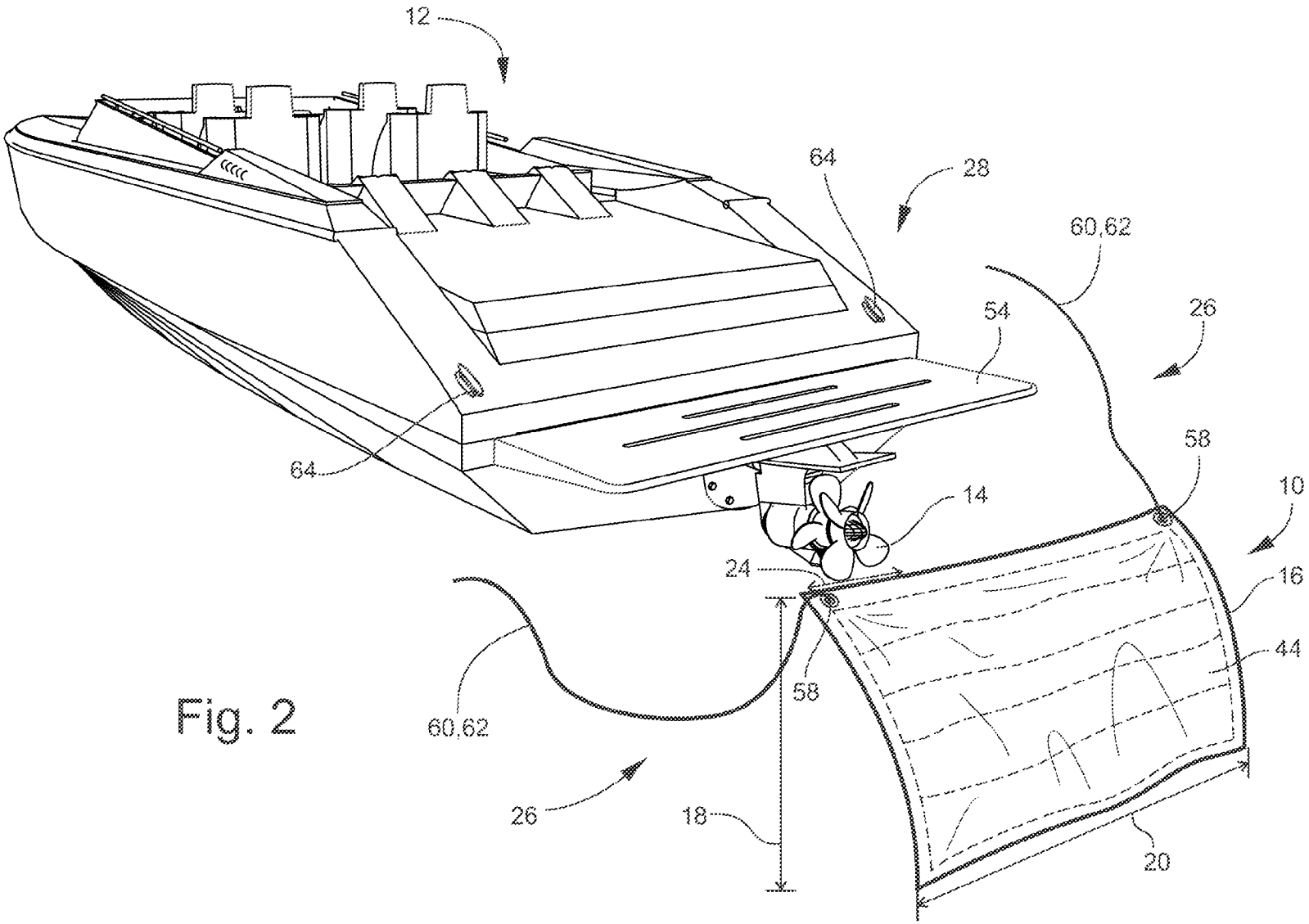
FIG. 2 is another perspective view of the embodiment from FIG. 1 removed from the back of the boat.
Figure 3:
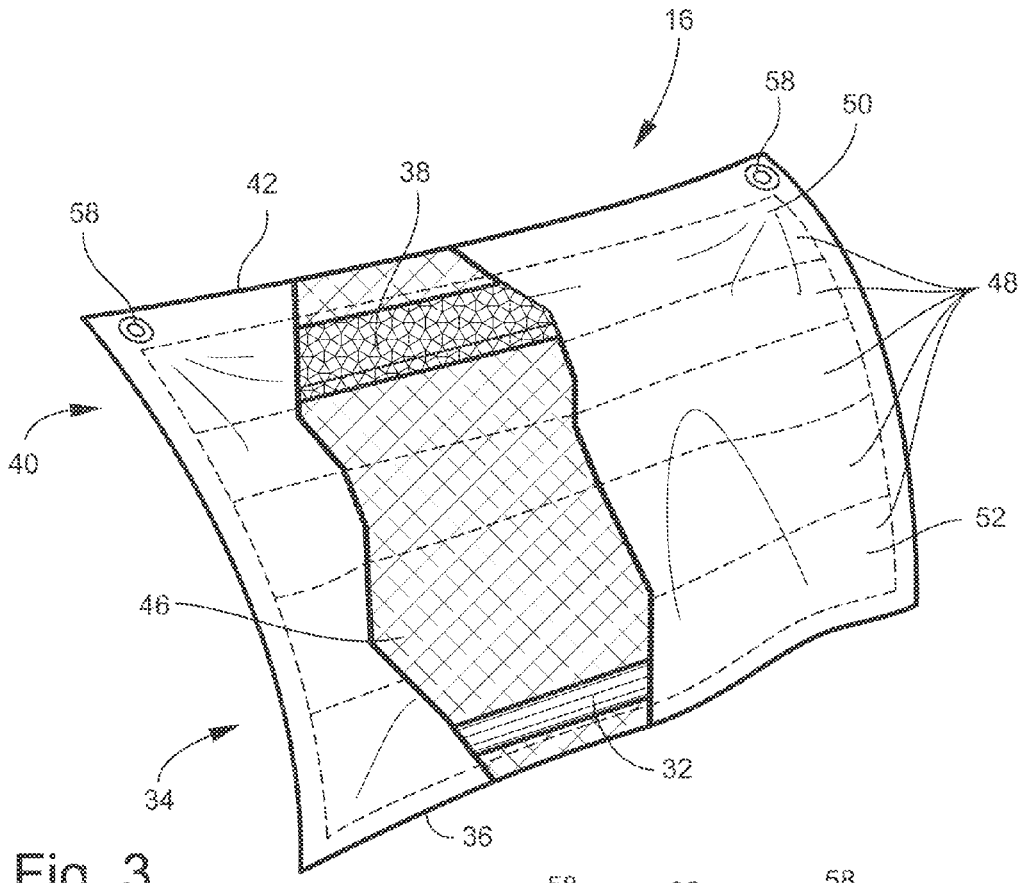
FIG. 3 is a partially broken away front view of the embodiment from FIG. 1.
Figure 4:
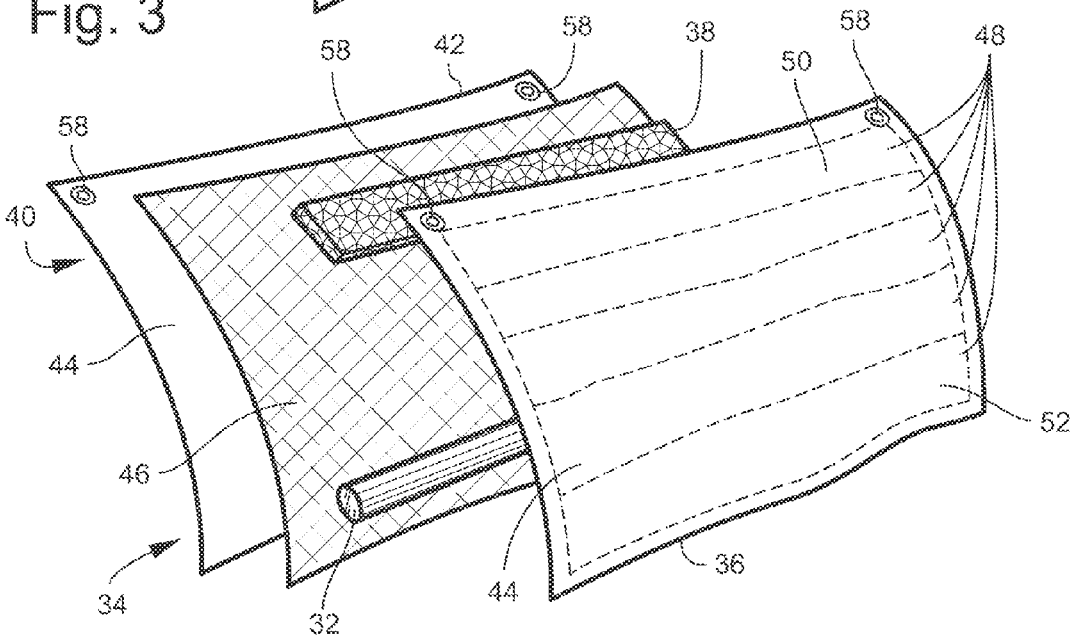
FIG. 4 is a partially disassembled perspective view of the embodiment from FIG. 1.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

In describing the exemplary embodiments of the present disclosure, as illustrated in FIGS. 1-10, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-9 by way of example, and not limitation, therein is illustrated example embodiments of propeller protection shield 10 for shielding propeller 14 of boat 12. As shown therein, propeller protection shield 10 generally comprises weighted skirt 16 and attachment means 26. Weighted skirt 16 may have height 18 and width 20. Height 18 may extend from surface 22 of the water to below propeller 14 of boat 12. Width 20 may extend at least width 20 of propeller 14. Attachment means 26 may be for securing weighted skirt 16 to back 28 of boat 12 behind propeller 14. Wherein, weighted skirt 16 may be positioned and/or rest approximately vertical 30 in the water behind propeller 14. Whereby, weighted skirt 16 may shield propeller 14 from contact in the water.

Weighted skirt 16, as used herein, may refer to a skirt, sheet, layer, tarp, blanket, cover, shield, membrane, piece, part, portion, member, the like, etc. that can be positioned behind propeller 14 for shielding propeller 14 from contact. In select embodiments, weighted skirt 16 may be flexible. In select embodiments, weighted skirt 16 may sink or have negative buoyancy. Weighted skirt 16 may optionally include weights or sinkers 32 for aiding in positioning of propeller protection shield 10. Weighted skirt 16 may be designed with any desired shape and/or size for providing any desired protection from propeller 14, including, but not limited to, any height 18 and/or width 20. In one embodiment, height 18 may be sized to extend from surface 22 of the water to at least 1 foot below propeller 14 of boat 12. In another embodiment, height 18 may be sized to extend from surface 22 of the water to at least 2 feet below propeller 14 of boat 12. In one embodiment, width 20 may extend at least two times of propeller width 24. In another embodiment, width 20 may extend approximately the width of boat 12.

Referring to FIGS. 1-4, in select embodiments, weighted skirt 16 may be provided in a substantially rectangular shape (or even squared shape) with squared off corners. This embodiment may provide weighted skirt 16 with a symmetric size and appearance.

Referring now to FIGS. 6-9, in other select embodiments, weighted skirt 16 may be provided in a rectangular shape (or even squared shape) with a rounded bottom. Rounded bottom may include rounded corners 66. This rounded bottom embodiment of weighted skirt 16 reduce the edges of weighted skirt, which may make weighted skirt safer, less likely to bend, more aesthetically pleasing, etc., the like, or combinations thereof.

Weighted skirt 16 may also be designed or made of any desired material. In one embodiment, as shown in FIGS. 1-9, weighted skirt 16 may include at least one layer of marine grade material 44. Marine grade material 44 may be for making weighted skirt 16 out of a material that may be durable under marine, water, boating, the like, etc. environments. Marine grade material 44 may be any material, whether currently known or later developed, that is designed for marine use, including, but not limited to, any marine upholstery fabric, marine vinyl fabric, boat cover fabric, marine fabric, marine upholstery, the like, and/or combinations thereof.

Weighted skirt 16 may also be designed to have any desired level of cut, tear and/or puncture resistance. The level of cut, tear and/or puncture resistance weighted skirt 16 may be desired for when weighted skirt 16 may come into contact with the sharp edges of the blades of propeller 14. In one embodiment, the cut, tear and/or puncture resistance may be provided by marine grade material 44 alone. In another embodiment, the cut, tear, and/or puncture resistance of weighted skirt 16 may be enhanced by reinforcing material 46. Reinforcing material 46 may be for reinforcing weighted skirt 16 and/or providing an enhanced level of cut, tear, and/or puncture resistance to weighted skirt 16. Reinforcing material 46 may be any desired material reinforcing weighted skirt 16 and/or providing an enhanced level of cut, tear, and/or puncture resistance to weighted skirt 16, including, but not limited to, any mesh, screen, cut resistant material, the like, and/or combinations thereof.

Referring to the embodiments shown in FIGS. 3-4 and 8-9, in select embodiments, weighted skirt 16 may comprise: two layers of marine grade material 44, and reinforcing material 46 sandwiched therebetween. Marine grade material 44 and reinforcing material 46 may be attached or formed together by any means to create weighted skirt 16, including, but not limited to, being sewn together, stapled, adhesively bonded, heat bonded, mechanically bonded, the like, and/or combinations thereof. In one embodiment, two layers of marine grade material 44 may be sewn together to create a plurality of horizontal pockets 48 within weighted skirt 16. In one embodiment, a single layer of reinforcing material 46 may be provided where weighted skirt 16 may be connected through reinforcing material 46. In another embodiment, a plurality of reinforcing materials 46 may be positioned in the plurality of horizontal pockets 48.

Sinker 32 or a plurality of sinkers 32 may optionally be included in propeller protection shield 10. See FIGS. 3-4 and 8-9. Sinker 32 may be for sinking bottom 36 of weighted skirt 16. As such, sinker 32 may aid in positioning weighted skirt 16 at approximately vertical 20. Sinker 32 or plurality of sinkers 32 may be any devices, objects or materials capable of sinking bottom 36, including, but not limited to, metal objects, fishing weights, ball barring's, bolts, toggle bolts, sand, the like, and/or combinations thereof. Sinkers 32 may be positioned anywhere on or in weighted skirt 16 capable of sinking bottom 36, including, but not limited to, in bottom portion 34 of weighted skirt 16. In one embodiment, sinker 32 or a plurality of sinkers 32 may be positioned in bottom horizontal pocket 52 of weighted skirt 16.

Float 38 or a plurality of floats 38 may optionally be included in propeller protection shield 10. See FIGS. 3-4 and 8-9. Float 38 may be for floating top 42 of weighted skirt 16. As such, float 38 may aid in positioning weighted skirt 16 to maintain top 42 of weighted skirt 16 at, or approximate to, surface 22 of the water. Float 38 or plurality of floats 38 may be any buoyant devices, objects or materials capable of floating top 42, including, but not limited to, plastic foams, styrofoams, polystyrene foams, inflatables, and/or combinations thereof. Floats 38 may be positioned anywhere on or in weighted skirt 16 capable of floating top 42, including, but not limited to, in top portion 40 of weighted skirt 16. In one embodiment, float 38 or a plurality of floats 38 may be positioned in top horizontal pocket 50 of weighted skirt 16.

Attachment means 26 may secure weighted skirt 16 in any desired position on or around boat 12. In one embodiment, attachment means 26 may secure weighted skirt 16 below swim platform 54. Attachment means 26 may also be any device or mechanism for securing weighted skirt 16 to back 28 of boat 12 behind propeller 14. In one embodiment, attachment means 26 may include eyelets 58 in each top corner of weighted skirt 16, and a securing line 60 for each eyelet 58 that may connect weighted skirt 16 to back 28 of boat 12 via each eyelet 58. Securing lines 60 may be any device or objects for connecting eyelets 58 to back 28 of boat 12, including, but not limited to, any ropes, strings, cords, chains, belts, bands, the like, combinations thereof, etc. In addition, securing lines 60 may attach to boat 12 by any means, including, but not limited to, cleats 64, or any other desired attachment already existing on boat 12 or later added to boat 12. In one embodiment, as shown in FIGS. 1-2 and 6-7, securing lines 60 may be ropes that may be sized for attachment to back cleats 64 of boat 12.

Figure 5:
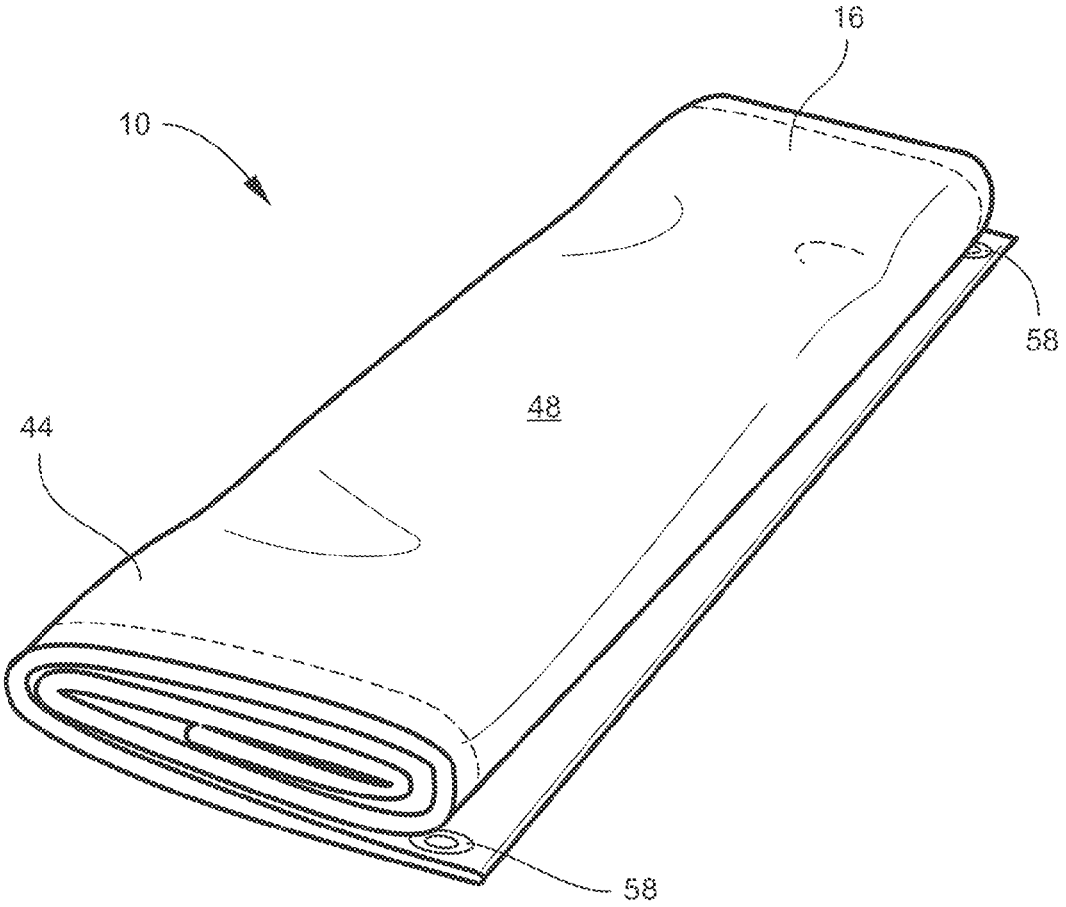
FIG. 5 is a perspective view of another embodiment of the propeller protection shield folded.

Referring to FIG. 5, in select embodiments, weighted skirt 16 may be foldable. Foldable, as used herein, means, that weighted skirt 16 may be folded, wrapped, doubled, bent, gathered, pleated, the like, etc. In one embodiment, as shown in FIG. 5, weighted skirt 16 may be folded upon itself multiple times to reduce the size of propeller protection shield 10, thus, making propeller protection shield 10 readily transportable and/or easy to store. Weighted skirt 16 may include any number of foldable sections or areas. In one embodiment, as shown in FIG. 5, weighted skirt 16 may be foldable about each horizontal pocket 48. In select embodiments, propeller protection shield 10 may include securement means for securing weighted skirt 16 in a folded position for transport and/or storage. This securement means may include any ropes, ties, cords, wraps, bands, the like, etc. In one embodiment, securing lines 60 may be used as the securement means for securing weighted skirt 16 in a folded position for transport and/or storage.

Figure 6:
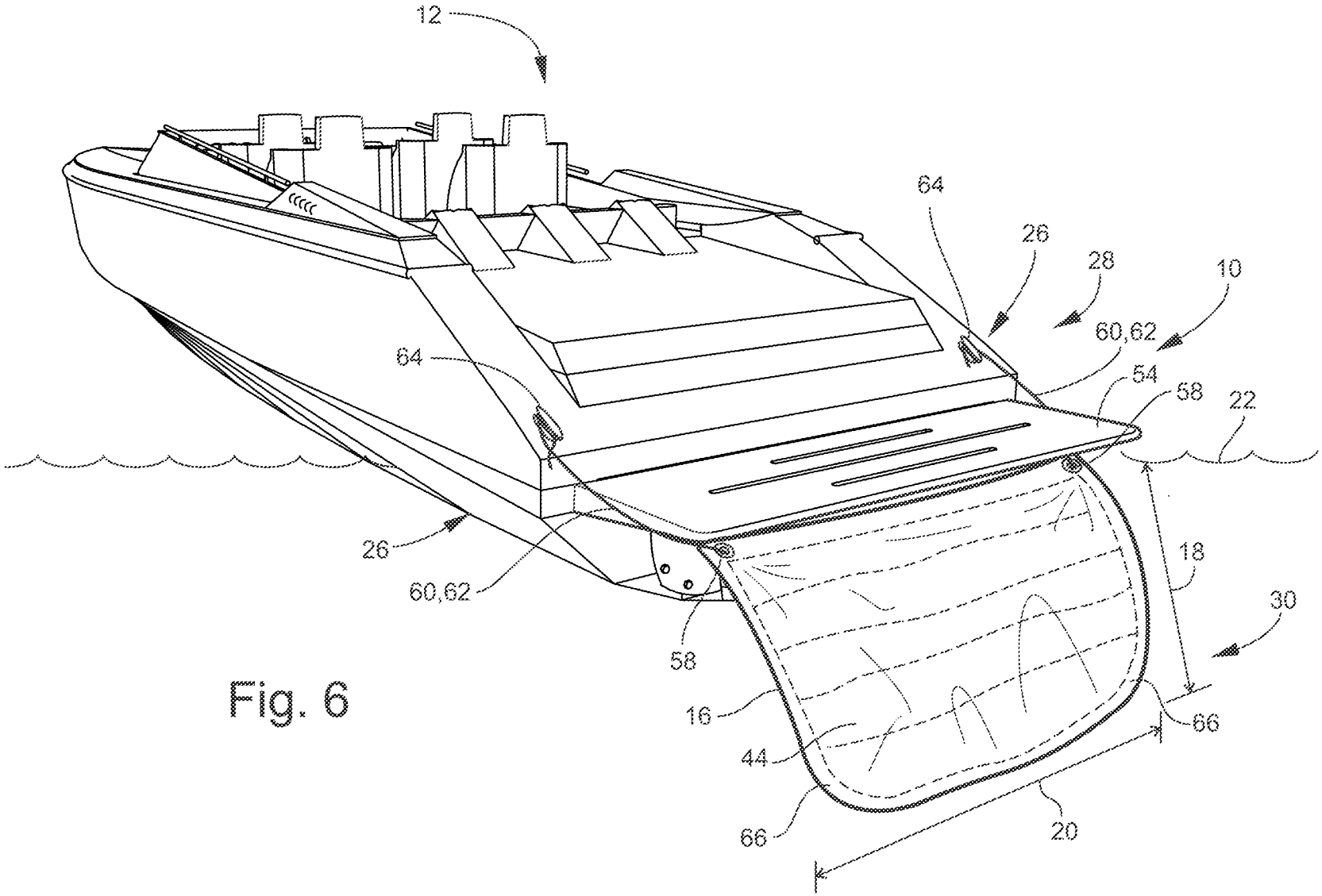
FIG. 6 is a perspective view of another exemplary embodiment of the propeller protection shield mounted on the back of a boat with a rounded bottom.
Figure 7:
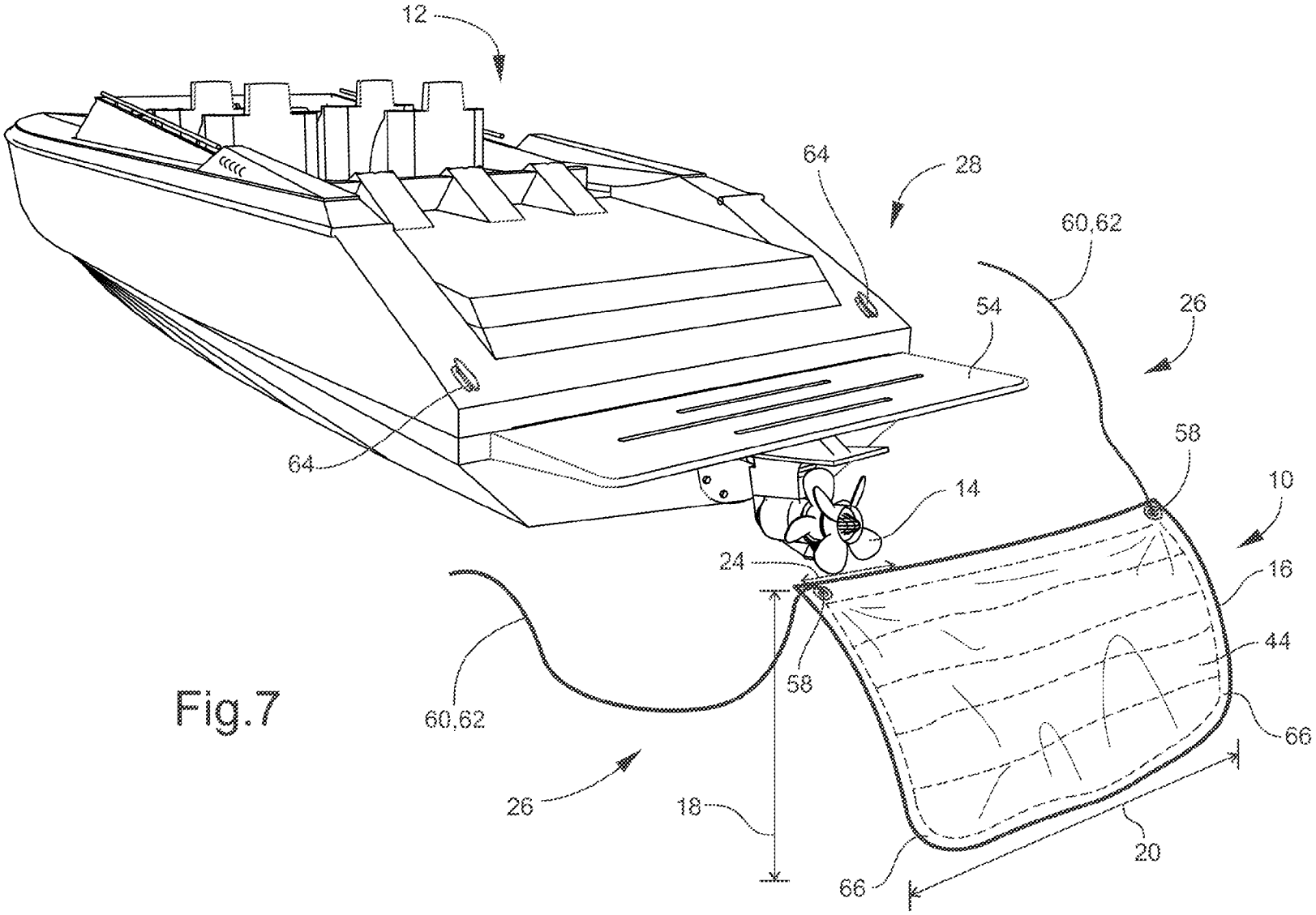
FIG. 7 is another perspective view of the embodiment from FIG. 2 removed from the back of the boat.
Figure 8:
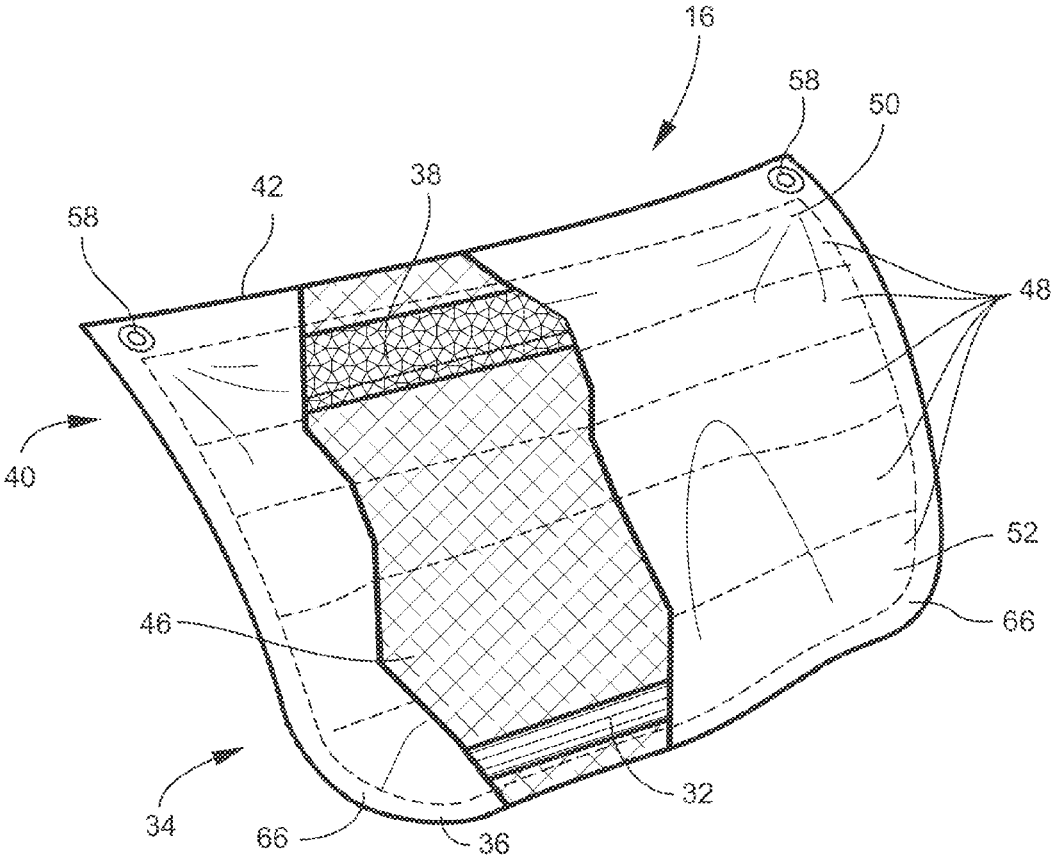
FIG. 8 is a partially broken away front view of the embodiment from FIG. 2.
Figure 9:
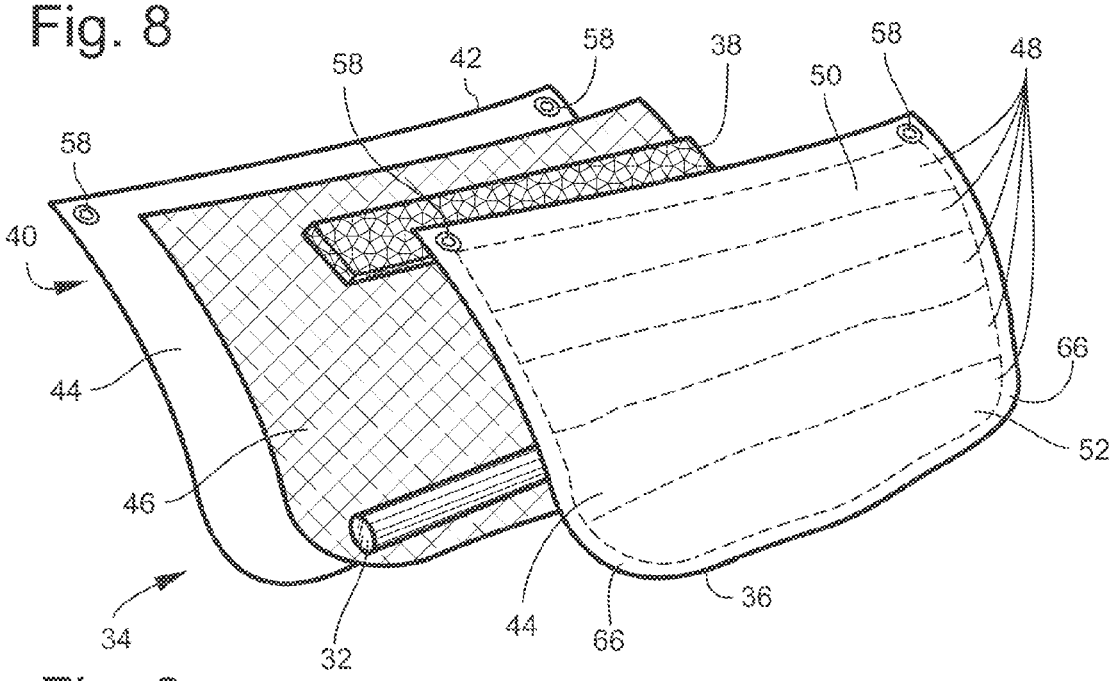
FIG. 9 is a partially disassembled perspective view of the embodiment from FIG. 2.
Figure 10:
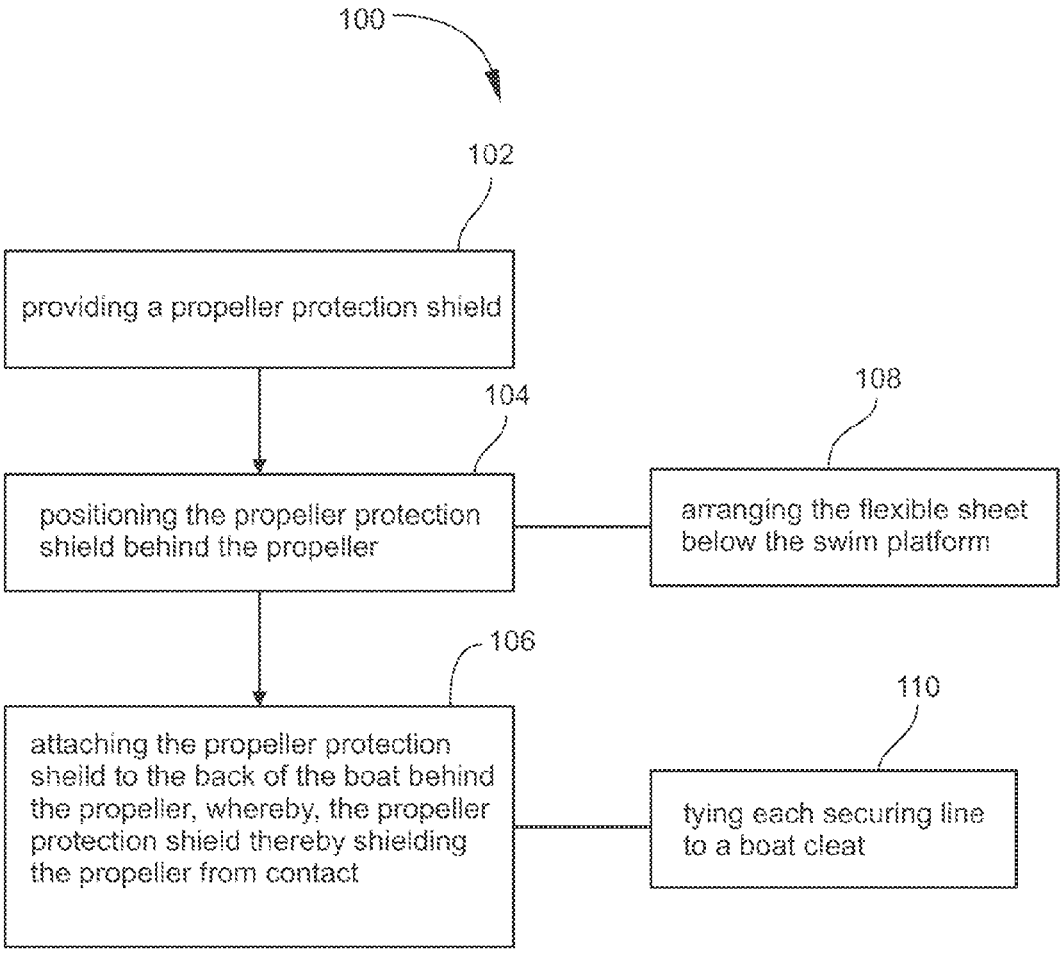
FIG. 10 is a flow chart depicting an exemplary embodiment of the method of shielding the propeller of a boat for protecting boater.

Referring now to FIG. 6, in use, method 100 of shielding the propeller of a boat for protecting boaters may be conducted using various embodiments of propeller protection shield 10 as shown and described herein. Method 100 of shielding the propeller of a boat for protecting boaters may generally include the steps of: step 102 of providing propeller protection shield 10 in any of the various embodiments as shown and described herein, step 104 of positioning the propeller protection shield 10 behind propeller 14; and step 106 of attaching propeller protection shield 10 to back 28 of boat 12 behind propeller 14, whereby, propeller protection shield 10 thereby shielding propeller 14 from contact in the water.

Referring again to FIG. 6, one feature of method 100 of shielding the propeller of a boat for protecting boaters may be, when attachment means 26 of propeller protection shield 10 includes eyelets 58, and securing lines 60, step 104 of positioning the propeller protection shield 10 behind propeller 14 may include step 108 of arranging weighted skirt 16 below swim platform 54. In addition, step 106 of attaching propeller protection shield 10 to back 28 of boat 12 behind propeller 14 may include step 110 of tying each securing line 60 to a boat cleat.

The advantages of propeller protection shield 10 may be numerous, including, but not limited to, that it may provide protection from propeller 14 for boaters while being easy to install, easy to remove, is lightweight, and can be easily stored on or in boat 12.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A propeller protection shield for a propeller of a boat, wherein said propeller protection shield comprises:

a weighted skirt having a substantially rectangular shape with a height and a width, said height is configured to extend from the surface of the water to below the propeller of the boat, and said width is configured to extend at least a width of the propeller, said weighted skirt comprises at least one sinker disposed in a bottom horizontal pocket along the longitudinal length of a bottom edge of the weighted skirt, wherein said at least one sinker is configured to sink the bottom of the weighted skirt;

said weighted skirt comprises at least one float disposed in a top horizontal pocket along the longitudinal length of a top edge of the weighted skirt, wherein said at least one float is configured to maintain the top of the weighted skirt at the surface of the water;

said weighted skirt includes an attachment means for securing the weighted skirt to the back of the boat behind the propeller, said attachment means includes an eyelet in each top corner of said weighted skirt;

wherein, said weighted skirt is configured to be positioned approximately vertical in water behind the propeller;

whereby, said weighted skirt shielding the propeller from contact in the water.

2. The propeller protection shield for a propeller of a boat of claim 1 wherein said weighted skirt includes at least one layer of marine grade material.

3. The propeller protection shield for a propeller of a boat of claim 2 wherein said weighted skirt further comprises a layer of reinforcing material.

4. The propeller protection shield for a propeller of a boat of claim 3 wherein said weighted skirt comprises:

two layers of said marine grade material; and said reinforcing material sandwiched therebetween.

5. The propeller protection shield for a propeller of a boat of claim 4 wherein said two layers of said marine grade material are sewn together to create the plurality of the horizontal pockets within said weighted skirt, whereby a plurality of said reinforcing materials are positioned in said plurality of the horizontal pockets.

6. The propeller protection shield for a propeller of a boat of claim 1 wherein said attachment means secures the weighted skirt below a swim platform.

7. The propeller protection shield for a propeller of a boat of claim 1 wherein said attachment means comprises:

a securing line for each eyelet that connects the weighted skirt to the back of the boat via each of the eyelets.

8. The propeller protection shield for a propeller of a boat of claim 7 wherein said securing lines are ropes being sized for attachment to at least one back cleat of the boat.

9. The propeller protection shield for a propeller of a boat of claim 1 wherein said height extends from the surface of the water to at least 1 foot below the boat propeller.

10. The propeller protection shield for a propeller of a boat of claim 1 wherein said width extends at least two times the width of the propeller.

11. The propeller protection shield for a propeller of a boat claim 1 wherein said weighted skirt is foldable.

12. The propeller protection shield for a propeller of a boat of claim 11 wherein said weighted skirt is foldable about each of the horizontal pockets.

13. The propeller protection shield for a propeller of a boat of claim 1 wherein said weighted skirt having a square or rectangular shape with a squared bottom or a rounded bottom with rounded corners.

14. A method of shielding a propeller of a boat for protecting boaters comprising the steps of:

providing a propeller protection shield comprising:

a weighted skirt having a substantially rectangular shape with a height and a width, said height is configured to extend from the surface of the water to below the propeller of the boat, and said width is configured to extend at least a width of the propeller, said weighted skirt comprises at least one sinker disposed in a bottom horizontal pocket along the longitudinal length of a bottom edge of the weighted skirt, wherein said at least one sinker is configured to sink the bottom of the weighted skirt;

said weighted skirt comprises at least one float disposed in a top horizontal pocket along the longitudinal length of a top edge of the weighted skirt, wherein said at least one float is configured to maintain the top of the weighted skirt at the surface of the water;

said weighted skirt includes an attachment means for securing the weighted skirt to the back of the boat behind the propeller, said attachment means includes an eyelet in each top corner of said weighted skirt;

wherein, said weighted skirt is adapted to rest approximately vertical in the water behind the propeller;

positioning the propeller protection shield behind the propeller; and attaching the propeller protection shield to the back of the boat behind the propeller, whereby, said propeller protection shield thereby shielding the propeller from contact in the water.

15. The method of shielding a propeller of a boat for protecting boaters of claim 14 wherein the attachment means of the propeller protection shield comprising:

a securing line for each eyelet for connecting the weighted skirt to the back of the boat via each of the eyelets;

wherein said method further comprising the steps of:

arranging the weighted skirt below a swim platform; and tying each securing line to a boat cleat.

* * * * *